US006089700A

United States Patent [19]

Ahn

[11] Patent Number: 6,089,700

[45] **Date of Patent: *Jul. 18, 2000**

[54] INK-JET PRINTER HEAD AND INK SPRAYING METHOD FOR INK-JET PRINTER

[75] Inventor: Byung-Sun Ahn, Suwon-si, Rep. of Korea

[73] Assignee: SamSung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,480

[22] Filed: Jun. 16, 1997

[30] Foreign Application Priority Data

Jun. 14, 1996 [KR] Rep. of Korea ..... 96-21426

[51] Int. Cl.[7] ..... B41J 2/05

[52] U.S. Cl. ..... 347/61

[58] Field of Search ..... 347/54, 61, 55

[56] References Cited

U.S. PATENT DOCUMENTS

| | | | |
|---|---|---|---|
| 4,275,290 | 6/1981 | Cielo et al. | 219/216 |
| 4,893,191 | 1/1990 | Tanaka et al. | 358/298 |
| 5,368,683 | 11/1994 | Altavela et al. | 156/633 |
| 5,400,061 | 3/1995 | Horio et al. | 347/55 |
| 5,787,327 | 7/1998 | Matsushita et al. | 399/130 |
| 5,790,142 | 8/1998 | Uchinami et al. | 347/15 |

FOREIGN PATENT DOCUMENTS

| | | | |
|---|---|---|---|
| 2-185446 | 7/1990 | Japan | 347/61 |

*Primary Examiner*—John Barlow
*Assistant Examiner*—Michael S. Brooke
*Attorney, Agent, or Firm*—Robert E. Bushnell, Esq.

[57] ABSTRACT

An ink-jet printer head constructed with individual electrodes formed on a silicon substrate on which oxidization is performed, and each having a region, wetted with an ink, and the other regions coated with insulating layers. A nozzle plate used as a common electrode, is formed on a layer different from the layers of the individual electrodes, and is perforated with orifices through which ink particles are sprayed onto print media. A region wetted with the ink is electrically isolated from the individual electrodes by the insulating layers, produces bubbles in the ink on receipt of electric energy. Ink chamber barriers electrically isolate from each other the adjacent regions of individual electrodes that are wetted with the ink, and thereby increase the force of the jet ejecting the ink droplets. Ink chambers are formed by the ink chamber barriers, each temporarily storing the ink. Bubbles are generated by a difference in the electric current density between the individual electrodes and nozzle plate. The insulating layers prevent leakage current to the adjacent individual electrodes while electrical connectors furnish electric energy to the individual electrodes and nozzle plate.

19 Claims, 8 Drawing Sheets

INK-JET PRINTER HEAD AND INK SPRAYING METHOD FOR INK-JET PRINTER

CLAIM FOR PRIORITY

This application makes reference to, incorporates the same herein, and claims all benefits accruing under 35 U.S.C. § 119 from INK-JET PRINTER HEAD AND INK SPRAYING METHOD FOR INK-JET PRINTER earlier filed in the Korean Industrial Property Office on Jun. 14$^{th}$ 1996, and there duly assigned Ser. No. 1996/21426, a copy of the same being attached hereto.

BACKGROUND OF THE INVENTION

1. Field of the Invention

The present invention relates to ink-jet printers generally and, more particularly, to processes and apparatus for spraying ink from the chamber for the head of an ink jet printer and onto a printable medium.

2. Discussion of Related Art

Typically, conventional ink-jet printers include a central processing unit that is driven by signals received from a host computer through a printer interface, to read a system program from memory, to store values initially set for the printing operation and various information necessary for the printing system, and to then execute the system program to produce a control signal; a read only memory that holds programs for controlling the printer; and a random access memory that temporarily stores data for operation of the system. An application-specific integrated circuit transmits data from the central processing unit to most of the peripheral logic ASICs as may be necessary to execute the instructions from the central processing unit, a head driver that controls the operation of ink cartridge in response to an output control signal from the central processing unit, a maintenance motor driving circuit that serves to drive a maintenance motor and prevent the nozzle of ink cartridge from being exposed to air, a carriage motor driving circuit that controls the operation of a carriage return driving motor, and a line feed motor driving circuit which controls the operation of a line feed motor to feed paper to a top output tray by using a stepping motor. A print signal, transmitted to the print interface from the host computer, actuates these motors in response to control signals from the central processing unit during performance of the printing operation. The ink cartridge sprays small drops of ink on paper through a plurality of orifices in a nozzle to form characters on the paper in a dot-matrix format.

The ink cartridge includes ink absorbed by a sponge held in a case, and an ink-jet printer head constructed with a filter to remove impurities from the ink, an ink stand pipe chamber storing ink that is filtered by the filter, an ink via suppling a chip containing ink heating portions and ink chambers, with the ink delivered through a stand pipe chamber, and a nozzle plate having a plurality of orifices for expelling the ink, transmitted from ink via. The ink via provides ink to the ink chambers between the nozzle plate and chip, a plurality of ink channels transmit the ink to each orifice of the nozzle plate from the ink via, ink chambers that spray the ink supplied from ink channels. A plurality of electrical connectors that furnish electrical power to the ink chambers.

Ink-jet printer head includes a resistor layer that is formed over a silicon oxide film created on a silicon substrate, for heating the ink with the electric energy. Two electrode layers are formed over resistor layer. Multi-layer protective layers prevent heating portions created between the two electrodes and resistor layer from being eroded and deformed by chemical interaction with the ink. Ink chambers produce ink bubbles in the ink with the heat generated by the heating portions. Ink-jet printer head is typically constructed with ink channels that serve as a passage for leading the ink from ink via into ink chambers. Ink barriers serve as a wall to form a space used for leading the ink from the ink channels into ink chambers. A nozzle plate contains a plurality of orifices through which every ink particle, pushed according to its volume change, is sprayed onto the print media.

Nozzle plate and heating portions are spaced a predetermined distance away from each other for mutual correspondence. The pair of electrodes are connected with a bumper for electrical connection. This bumper is electrically connected with a head controller so that the ink particles can be sprayed through each orifice of the nozzle. Each ink barrier is formed to lead the ink from the side of heating portions, and is connected with common ink via to direct the ink flow out of an ink container. Head driver furnishes electric energy to a pair of electrodes in response to a control instruction that receives a command to print through the printer interface. The power is transmitted through the two electrodes to heat heating portions by the heat of electrical resistance, i.e., joule heat ($P=I^2 \cdot R$) for a predetermined period of time. The top surface of the heating portions are heated to 500° C.~550° C. to transmit the heat to multi-layer protective layers. The heat is transmitted to the ink particles spreading across the protective layers. More ink bubbles are produced by the steam pressure in the middle of the heating portions than in any other area, and the highest steam pressure is created in the middle of the heating portions. The ink bubbles, produced by this heat, cause a change in the volume of the ink on the top of the heating portions. Ink particles that are pushed as the volume of ink is changed, are jetted out through the orifices of nozzle plate.

If the electric energy, furnished to two electrodes is cut off, the heating portions cool instantaneously, and the ink bubbles are deflated and the ink returns to its original state. The ink particles, discharged to the outside, are sprayed on paper in the shape of small drops by surface tension, thus forming characters on paper in a dot-matrix format. The ink chamber's internal pressure drops according to the change in the bubble volume, and the ink from the ink container refills nozzle plate through ink via.

I have noticed that conventional ink spraying mechanism, using the conventional ink-jet printer head, has the following disadvantages. First, when forming bubbles with the super-heat so as to spray the ink onto print media, the composition of the ink may be changed by the heat, and a shock wave, created by the generation and breaking of the ink bubbles, deleteriously affects the internal components of the head, with a concomitant reduction in performance and print quality.

Second, as the ink adheres to the resistor layer and the two electrodes, the ink interacts electrically with the two electrodes, and, accordingly, the corrosion occurs by the ion exchange at each boundary layer of the heating portions and two electrodes causes corrosion, thus reducing the operational life of the head.

Third, the shock wave, created by the generation of ink bubbles at the ink barrier containing the ink, causes an increase in the refresh cycle.

Fourth, the ink drop's straightforwardness and roundness, and the uniformity in the amount of ink discharged—all of which affect the print quality—depend on the shape of the ink drop. The manufacturing process forming the multi-layer protective layers over the electrodes and the resistor has become complicated, with concomitant increase in production costs.

Recent efforts to solve these problems include the formation of first and second electrodes are on and under a nozzle plate, with a nozzle being formed by using an eximer laser. The nozzle is directly connected to an ink container to introduce conductive ink into the nozzle by using capillarity. High voltages are applied to the two electrodes to heat and evaporate the conductive ink inside the nozzle. The steam pressure, generated during this process, causes the ink particles inside the nozzle to be sprayed onto the print media. The upper section of the nozzle is larger than the lower section, and the voltage applied to each electrode is about 1000 Volts~3000 Volts at a frequency of up to 10 kiloHertz.

I have noticed however, that with this improved technique, as the ink inside nozzle is heated by the high voltage to be sprayed on the paper, the length of nozzle should necessarily be long. A hole in the electrode connected with the nozzle is larger than a cross-sectional area of the nozzle's lower section. Therefore, when the voltage is applied to each electrode, it is difficult to achieve a concentration of electric current density that is satisfactory, thus necessarily requiring application of high voltages. The nozzle plate, having two electrodes and a nozzle, must be formed thick, and the time required to manufacture nozzle plate is long, thus increasing the overall production costs.

SUMMARY OF THE INVENTION

Accordingly, it is one object of the present invention to provide an improved ink-jet printer head that substantially obviates one or more of the problems, limitations and disadvantages of the related art.

It is another object to provide an ink-jet printer head for an ink-jet printer and a process for spraying ink in an ink-jet printer wherein the printer's nozzle plate is used as a common electrode, and ink bubbles are generated by a difference of current density of the common electrode and individual electrodes.

It is still another object to provide an ink-jet printer head with a nozzle having a cross-sectional area on the surface facing towards the print media that is smaller than the sectional area of the opposite surface facing towards the ink chambers.

It is yet another object to provide an ink-jet printer head with a nozzle having a cross-sectional area that enhances the straightness of ink drops emanating from the nozzle.

It is still yet another object to provide an ink-jet printer head having a nozzle plate formed as a very thin member, thereby reducing the time required to make the nozzle plate and consequently lowering production costs.

Additional features and advantages of the invention will be set forth in the description which follows, and in part will be apparent from the description, or may be learned through practice of the invention. The objectives and other advantages of the invention will be realized through the structure, particularly as pointed out in the written description and claims hereof, as well as the appended drawings.

To achieve these and other advantages, and in accordance with the purpose of the present invention as embodied and broadly described in this specification, the present invention contemplates the use of a nozzle plate as a common electrode, with individual electrodes formed on a substrate. Steam pressure created by a difference of current density between two electrodes is used for generation of ink bubbles from the ink.

According to another aspect of the present invention, the nozzle plate has a plurality of orifices each having a sectional area on the surface facing towards the print media that is smaller than the sectional area on the opposite surface of the nozzle plate facing towards the ink chambers.

Embodiments of the present invention include a plurality of individual electrodes formed on an oxidized layer of a silicon substrate. Each of the electrodes has a region wetted with the ink, and the other regions coated with insulating layers, a nozzle plate used as a common electrode, formed on a layer different from the layers for the individual electrodes, having a plurality of orifices through which ink particles are sprayed onto a print media and a region wetting with the ink, electrically isolated from the individual electrodes by the insulating layers, and producing bubbles in the ink on receipt of electric energy; and barriers within the ink chamber electrically isolating the adjacent regions of the individual electrodes, wetting with the ink, and increasing the jet force ejecting the ink while assuring a modicum of straightforwardness of the steam pressure.

The inventive ink-jet printer head also includes ink chambers formed by the ink chamber barriers, with each of the chambers temporarily storing the ink while enabling generation of bubbles by a difference of electric current density between the individual electrodes and the nozzle plate. Insulating layers prevent leakage of electrical current to the adjacent individual electrodes through the ink not contained within the ink chambers. Electrical connects furnish electric energy to the individual electrodes and the nozzle plate.

Practice of the present invention contemplates the steps of forming a plurality of individual electrodes and a nozzle plate on different layers to be electrically isolated from each other, using barriers as border lines; and applying voltages to the respective electrodes, using the nozzle plate as a common electrode, to produce ink bubbles with heat energy generated by the internal current and resistivity of the electrically conductive ink so that the ink bubbles are forced as jets through the orifices formed in the nozzle plate.

It is to be understood that both the foregoing general description and the following detailed description are exemplary and explanatory, and are intended to provide further explanation of the invention as claimed.

BRIEF DESCRIPTION OF THE ATTACHED DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

Figure 9:
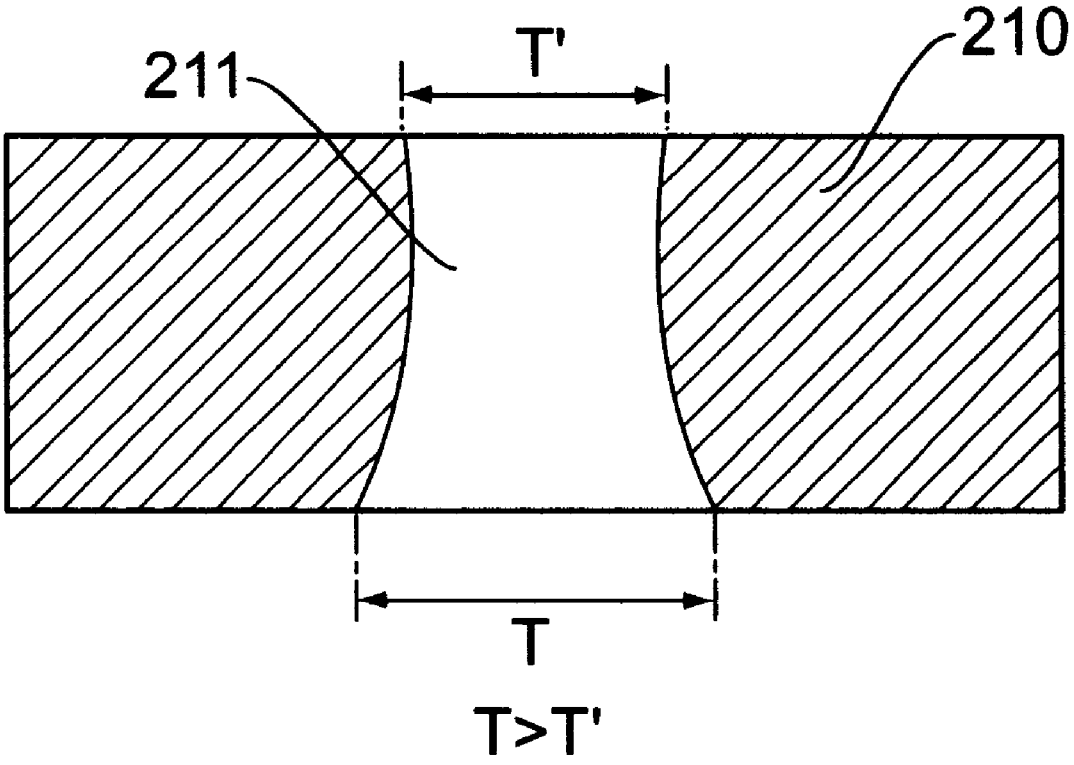
Figure 10A:
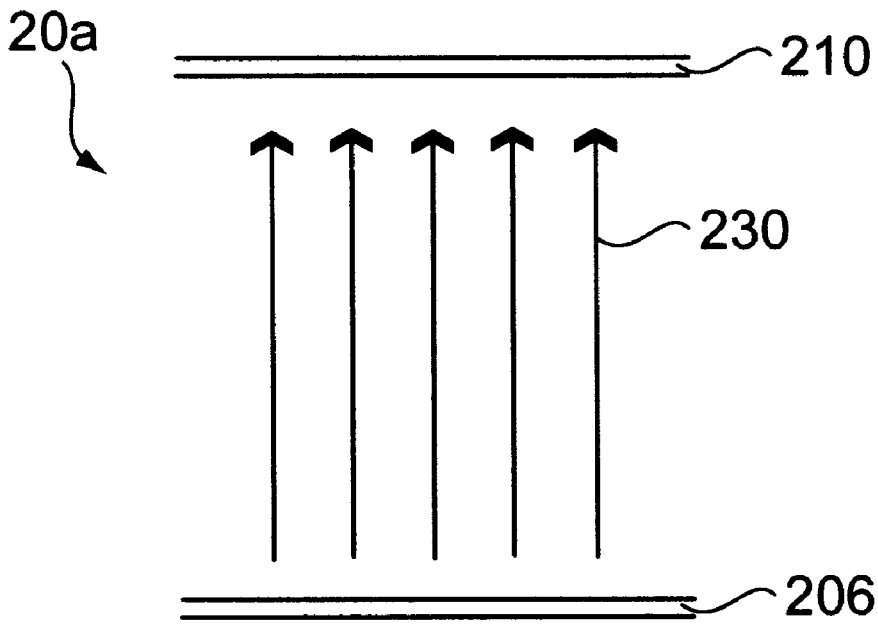
Figure 10B:
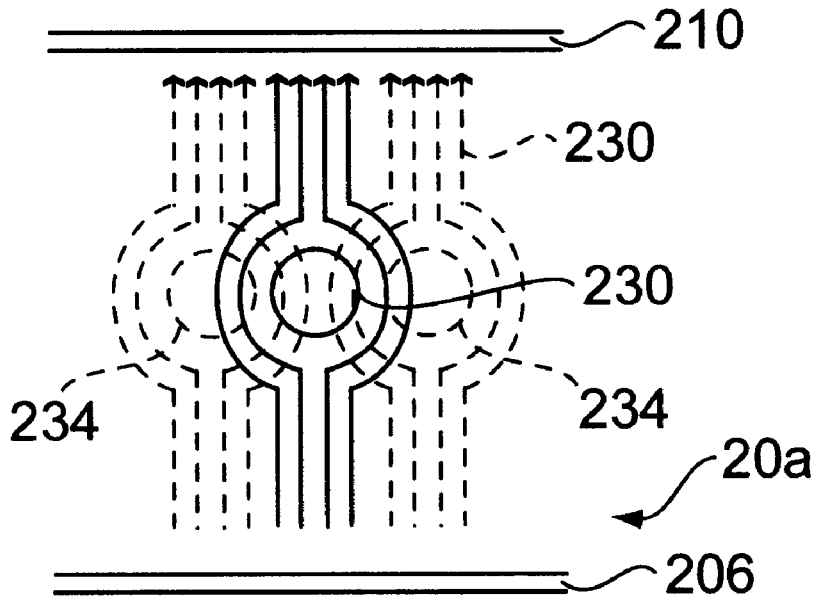

FIG. 9 schematically depicts a nozzle plate of the ink-jet printer head constructed in accordance with the principles of the present invention; and FIGS. 10A and 10B are illustrations representing physical aspects in the formation of bubbles during operation of an embodiment constructed according to the principles of the present invention.

DETAILED DESCRIPTION OF PREFERRED EMBODIMENT

Figure 1:
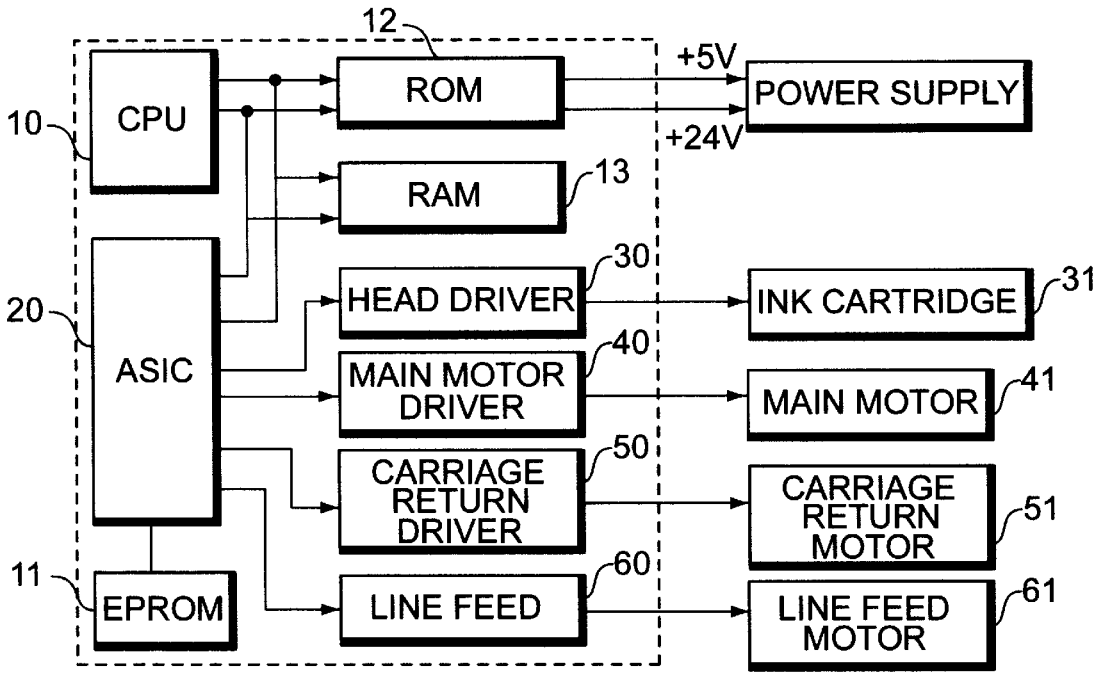
FIG. 1 is a block diagram illustrating an electronic circuit for controlling operation of an ink-jet printer.

Turning now to the drawings, the construction and operation of an electronic circuit for controlling operation of an ink-jet printer is illustrated by FIG. 1. Central processing unit (CPU) 10 receives signals from a host computer (not illustrated) through a printer interface (also not illustrated), and reads a system program stored on an erasable and programmable read only memory (EPROM) 11 that stores values initially set for the printing operation and various items of information necessary for operation of the printing system, and then executes the program in order to produce a control signal in accordance with the program. Read only memory (ROM) 12 holds programs for controlling the printer, and random access memory (RAM) 13 temporarily stores data used during operation of the system.

The control circuit has an application-specific integrated circuit (ASIC) 20 that transmits data from CPU 10 to most of the peripheral logic ASICs necessary for the operation of the system. Head driver 30 controls the operation of ink cartridge 31 in response to an output control signal from CPU 10 transmitted through ASIC 20. A main motor driving circuit 40 serves to drive a main motor 41 and prevent the nozzle of ink cartridge 31 from being exposed to air. Carriage motor driving circuit 50 controls the operation of a carriage return driving motor 51, and a line feed motor driving circuit 60 controls the operation of a line feed motor 61 for feeding paper and for discharging paper bearing printed images onto a top output tray by using a stepping motor. A print signal from the host computer, transmitted to CPU 10 by way of the print interface, actuates motors 40, 50 and 60, thereby enabling performance of the printing operation. Ink cartridge 31 sprays small drops of ink onto a print medium such as a cut sheet of paper, through a plurality of orifices formed in a nozzle of ink cartridge 31 to create images and characters on the paper in a dot-matrix format.

Figure 2:
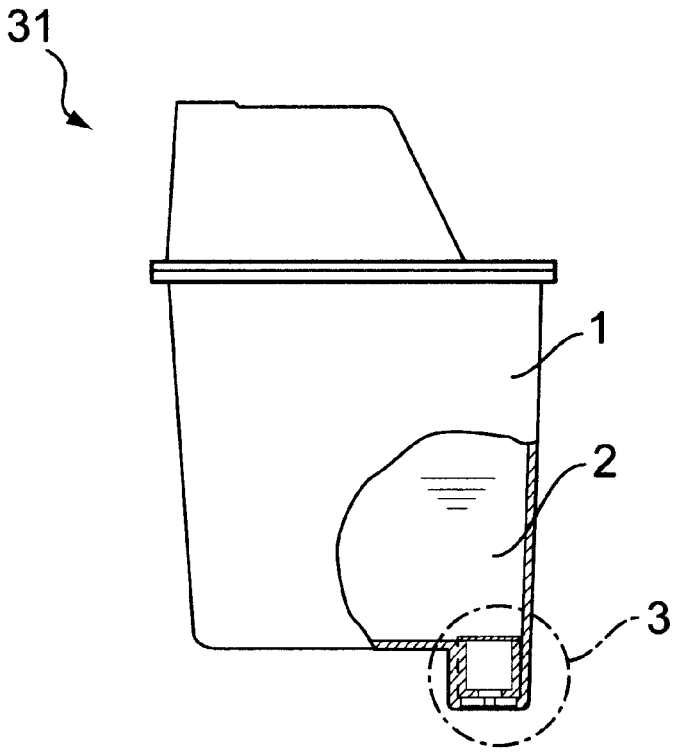
FIG. 2 is a sectional view of an ink cartridge of an ink-jet cartridge for an ink-jet printer.

Ink cartridge 31 is described in more detail with reference to FIGS. 2 and 3, a cross-sectional view and an enlarged view, respectively of ink cartridge 31 and ink-jet printer head 3 of ink cartridge 31. Ink cartridge 31 includes a quantity of an ink 2 absorbed by a sponge held in a case 1, and an ink-jet printer head 3. Ink-jet printer head 3 has a filter 32 which removes impurities from the ink, an ink stand pipe chamber 33 storing ink strained by filter 32, and an ink via 34 that supplies the ink to a chip 35. Chip 35 is constructed with ink heating portions and ink chambers, to receive the ink delivered through ink stand pipe chamber 33, and a nozzle plate 36 perforated by a plurality of orifices for expelling the ink transmitted from ink via 34 onto print media.

Figure 3:
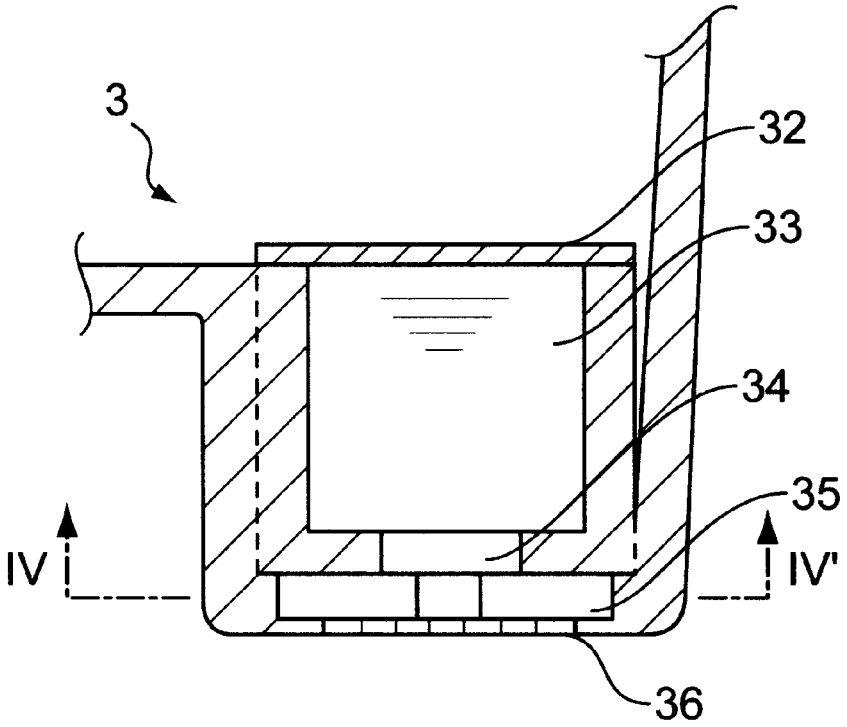
FIG. 3 is an enlarged view of the ink-jet printer head shown in FIG. 2.
Figure 4:
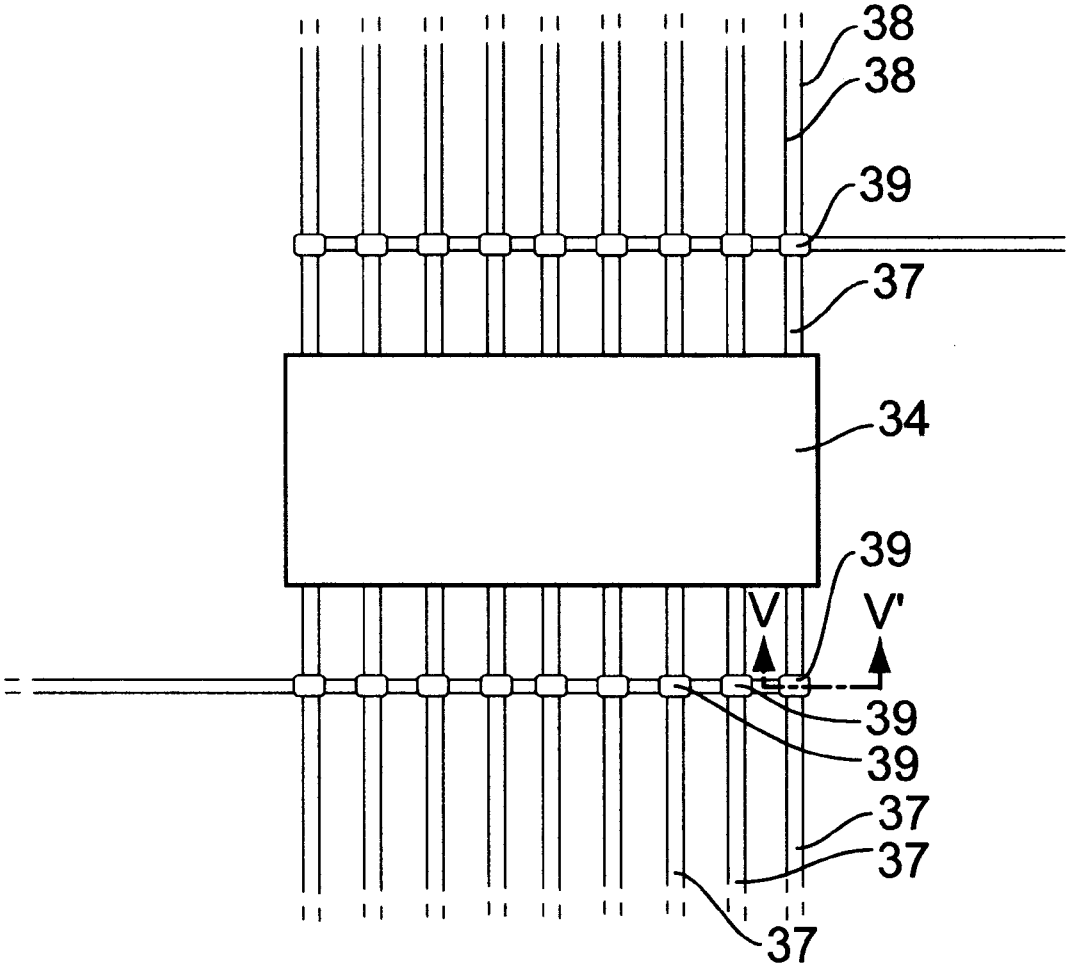
FIG. 4 is a sectional view as taken along sectional line IV-IV' of FIG. 3.

FIG. 4 is a cross-sectional view as taken along line IV-IV' of FIG. 3, that depicts ink via 34 for providing the ink to the ink chambers positioned between nozzle plate 36 and chip 35. A plurality of ink channels 37 transmit the ink to each orifice of nozzle plate 36 from ink via 34. Ink chambers 39 spray the ink supplied from ink channels 37, and a plurality of discrete and electrically separate electrical connectors 38 furnish power to ink chambers 39.

Figure 5:
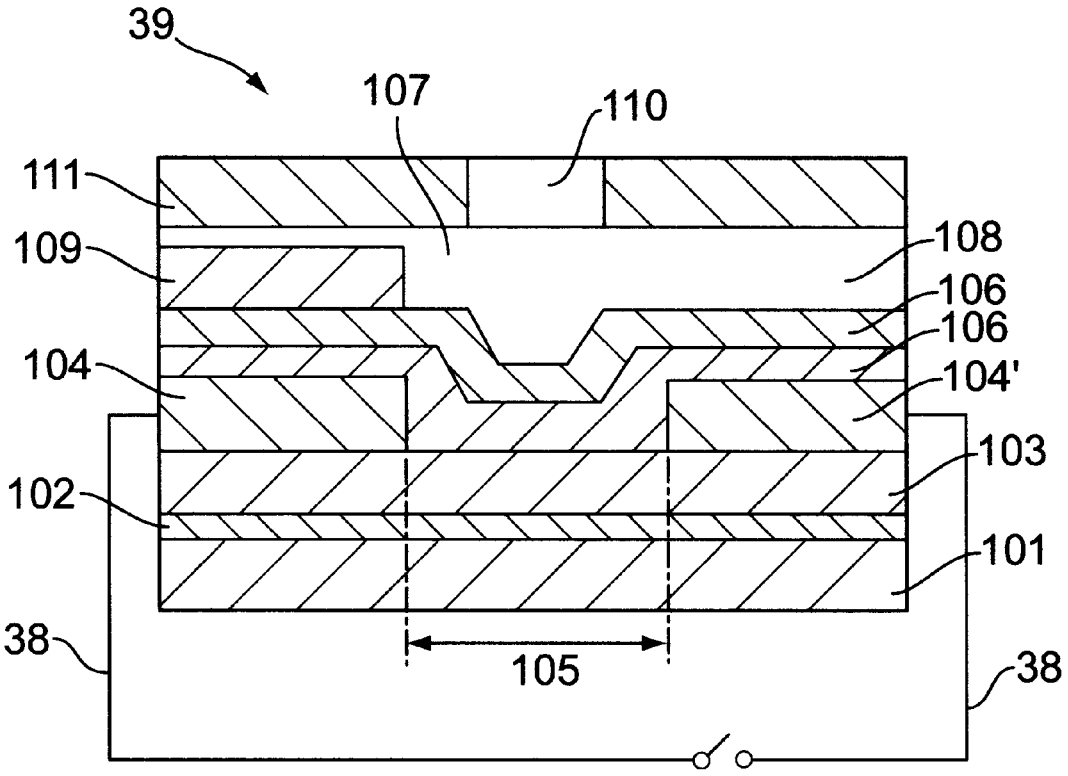
FIG. 5 is an enlarged-sectional view as taken along sectional line V-V' of FIG. 4.

FIG. 5 is an enlarged-sectional view of an ink chamber 39 as taken along line V-V' of FIG. 4, showing resistor layer 103 that is formed over silicon oxide film $SiO_2$ 102, created on a silicon substrate 101, that heats the ink with the electric energy. Two electrode layers 104 and 104' are formed over resistor layer 103 to provide electrical connection with connectors 38. Multi-layer protective layers 106 prevent heating portion 105, created between the two electrodes 104 and 104' and resistor 103, from being eroded and deformed by chemical interaction with the ink. Ink chamber 107 produces ink bubbles in the ink with the heat generated by heating portion 105.

Ink-jet printer head 3 also includes ink channels 108 that serve as passages for leading the ink from ink via 34 into ink chambers 107. Ink barriers 109 serve as a wall to form a space used for leading the ink from ink channels 108 into ink chambers 107. Nozzle plate 111 is perforated by a plurality of orifices 110 through which every ink particle is pushed according to its volume change, as a spray deposited onto print media. Nozzle plate 111 and heating portions 105, shown as coaxially and symmetrically aligned, are spaced apart by a predetermined distance from each other for mutual correspondence. A pair of electrodes 104 and 104' are electrically connected through a contact array referred to as a bumper, via leads 38 for electrical connection from the outside. This bumper is electrically connected with head driver 30 so that the ink particles are sprayed through each orifice 110 of nozzle plate 111. Each ink barrier 109 is formed to lead the ink from the side of heating portions 105, and is connected with common ink via 34 to direct the ink flow out of an ink cartridge.

The ink spraying mechanism of the conventional ink-jet printer head is now described by reference to FIG. 6. Head driver 30 furnishes electric energy to a pair of electrodes 104 and 104' in response to a control instruction of CPU 10 that receives a command to print through the printer interface. The power is transmitted through two electrodes 104 and 104' to heat heating portions 105 by the heat of electrical resistance, i.e., joule heat ($P=I^2 \cdot R$) for a predetermined period of time. The top surface of heating portions 105 is heated to a temperature within the range of 500° C.~550° C. in order to transmit the heat to multi-layer protective layers 106. At this point, the heat is transmitted to the ink particles spreading across the protective layers 106. More ink bubbles are produced by the steam pressure within the middle C of heating portions 105 than in any other area, and the highest steam pressure is created in the middle of heating portions 105. The ink bubbles produced by this heat cause a change in the volume of ink at the top of heating portions 105. Ink particles that are pushed as the volume of ink is changed, are forced as a jet of ink out through orifices 110 of nozzle plate 111. When electrical energy furnished to electrodes 104 and 104' is interrupted, heating portions 105 cool instantaneously, and the ink bubbles deflate and collapse, whereby ink within chamber 107 returns to its original state. The ink particles, discharged to the outside of orifice 110, are sprayed onto paper while in the shape of small drops by surface tension, thus forming characters on paper in a dot-matrix format. Internal pressure of ink chamber 107 drops according to the change in the volume of the bubbles, and the ink from the ink container refills nozzle plate 111 through ink via 34.

Figure 6:
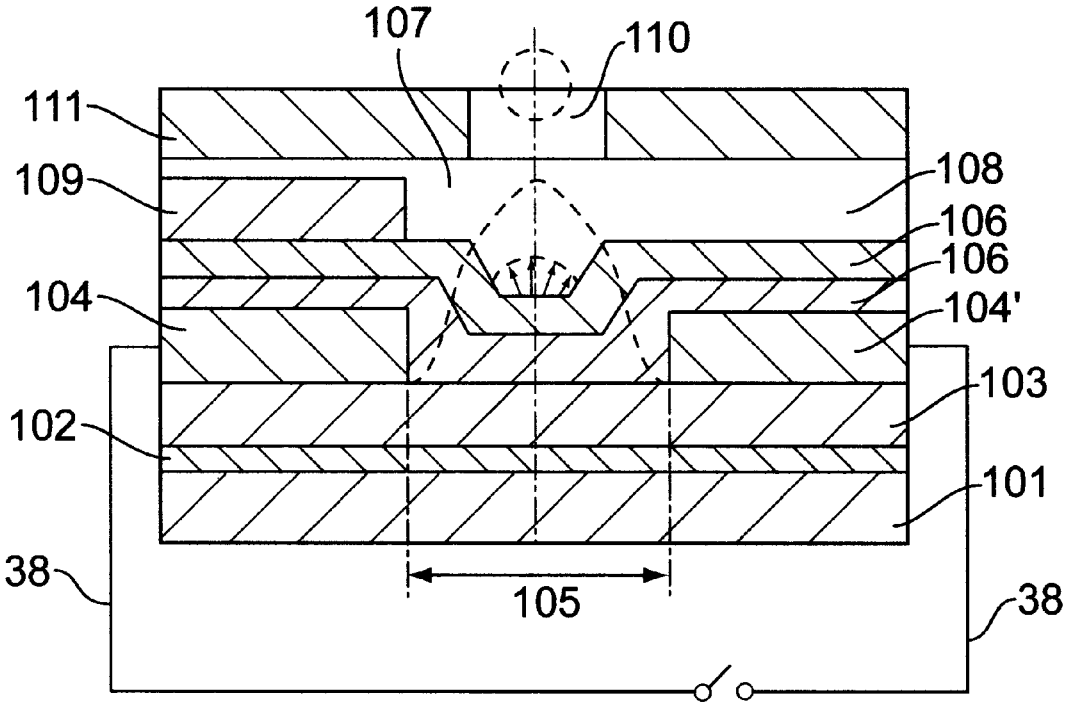
FIG. 6 shows the ink spraying mechanism constructed in accordance with the conventional art.
Figure 7:
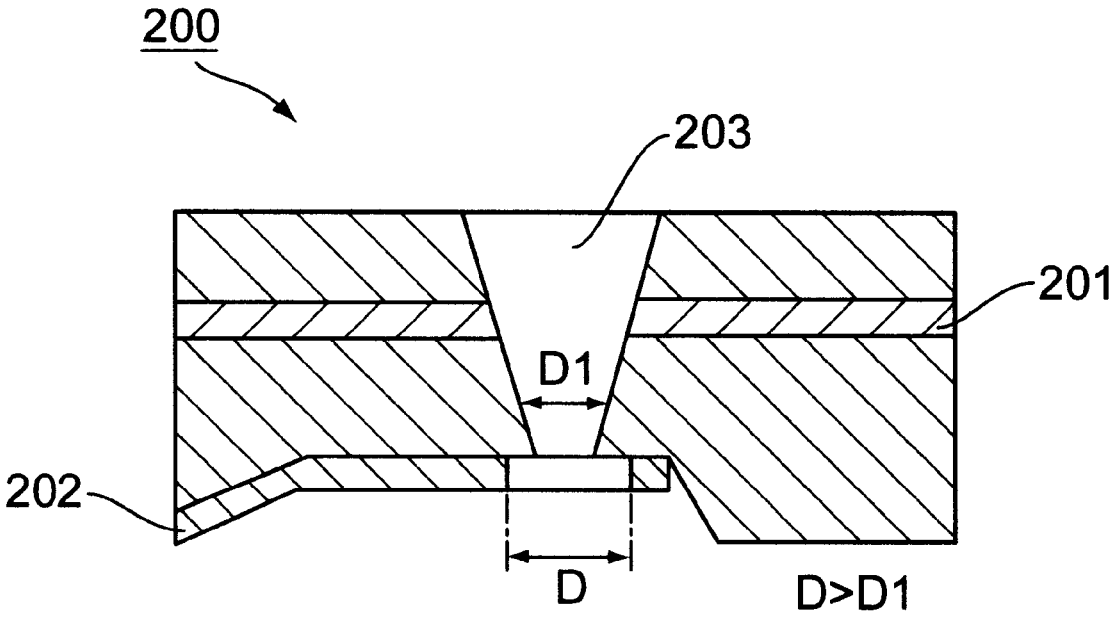
FIG. 7 depicts a nozzle plate of an ink-jet printer head constructed in accordance with an improvement in conventional art.

FIG. 7 shows an improved ink-jet printer head created to solve problems found in the performance of the printer head illustrated by FIGS. 5 and 6 but which is not a preferred embodiment of the present invention. First electrodes 201 and second electrodes 202 are respectively formed on and under a nozzle plate 200, and a nozzle 203 is formed by an eximer laser. Nozzle 203 is directly connected with an ink cartridge (not separately illustrated) to introduce electrically conductive ink into nozzle 203 by using capillarity. High voltages are applied to the pair of electrodes 201 and 202 in order to heat and evaporate the conductive ink in nozzle 203. The steam pressure, generated during this process, causes the ink particles in nozzle 203 to be sprayed onto print media such as cut sheets of paper. The upper section of nozzle 203 is larger than the lower section, and the voltage applied to each electrode is about 1000 Volts~3000 Volts at a frequency of up to 10 kiloHertz. As the ink in nozzle 203 is heated by the high voltage to be sprayed on the paper, the length of nozzle 203 is necessarily long. The cross-sectional dimension (e.g., the cross-sectional area) D of the orifice formed in second electrode 202 connected with nozzle 203, is larger than the cross-sectional area D1 of the lower section of nozzle 203. Thus, when the voltage is applied to each electrode 201, 202, it is difficult to obtain the concentration of electric current density necessary, thus requiring application of high voltages across electrodes 201, 202. Nozzle plate 200, having two electrodes 201 and 202 and nozzle 203, is formed to be thick. Consequently, the time required to manufacture nozzle plate 200 is long, a factor that increases the overall production cost of an ink jet printer.

Figure 8:
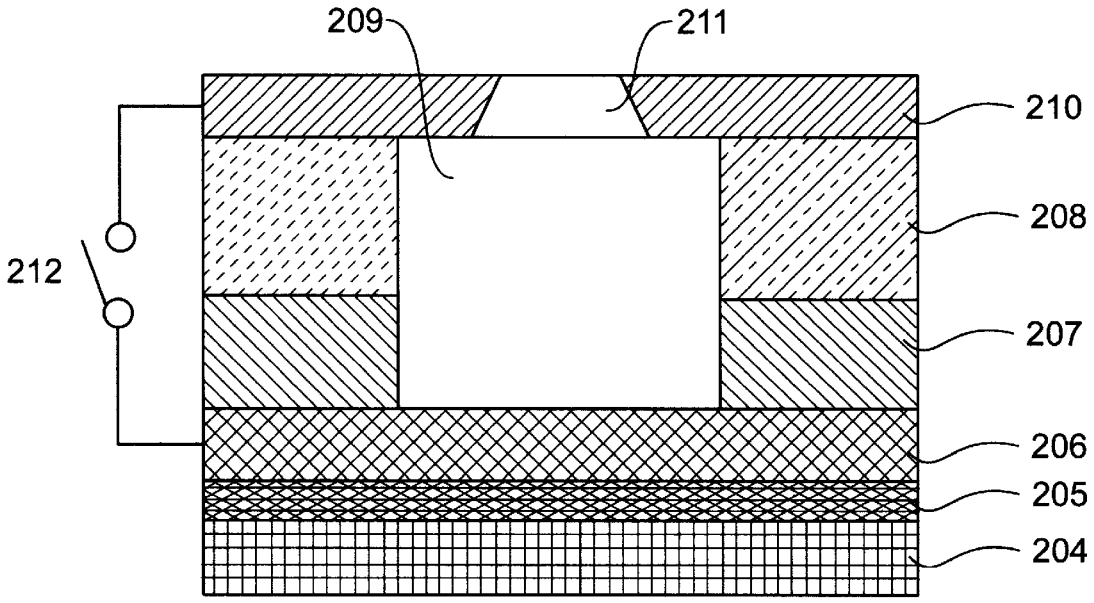
FIG. 8 is an enlarged sectional view of an ink-jet printer head constructed in accordance with the principles of the present invention.

Reference will now be made in detail to the preferred embodiments of the present invention, examples of which are illustrated in the accompanying drawings. FIG. 8 is an enlarged sectional view of an ink-jet printer head constructed in accordance with the principles of the present invention. The ink-jet printer head includes a silicon substrate 204. A silicon dioxide (i.e., $SiO_2$) layer 205 is formed on silicon substrate 204 by oxidization. A plurality of individual electrodes 206 each have a region wetted by the ink where bubbles are created in the ink, and other regions coated with electrically insulating layers 207. Nozzle plate 210, which is used as a common electrode, is formed on a layer different from the layer of individual electrodes 206. The central regions of nozzle plate 210 are wetted with the ink. A plurality of orifices 211 perforate nozzle plate 210. Ink particles are sprayed through orifices 211 onto print media. The regions of nozzle plates 210 that are wetted by the ink are electrically isolated from individual electrodes 206 by insulating layers 207, produce bubbles in the ink on receipt of electric energy. Ink chamber barriers 208 assure the straightness of the steam pressure by increasing the force of the jet expelling the ink from nozzle 211 through the expedient of electrically isolating adjacent individual regions of electrodes 206 that are wetted with the ink, from each other.

The ink-jet printer head is constructed to provide ink chambers 209 receiving the ink through barriers 208. Ink bubbles are produced by the electric current density between individual electrodes 206 and nozzle plate 210. Insulating layers 207 prevent leakage of electrical current to adjacent individual electrodes 206. Electrical connector 212 furnishes electric energy to individual electrodes 206 and to nozzle plate 210. The individual electrodes 206 and nozzle plate 210 are each formed of an alloy of nickel and platinum in order to prevent erosion due to the ion exchange with the conductive ink. Nozzle plate 210, which is used as a common electrode and is perforated by a plurality of orifices 211 corresponding to individual electrodes 206, respectively, controls the size of each of ink drops. Preferably, nozzle plate 210 is formed to a thickness of between approximatedly 30 $\mu$m to 40 $\mu$m, and supported by ink chamber barriers 208.

As shown in FIG. 9, each of the plurality of orifices 211 perforating nozzle plate 210, has a cross-sectional area characterized by the cross-sectional dimension (e.g., diameter) T at the surface facing inwardly towards ink chambers 209 that is larger than the cross-sectional dimension T' of the cross-sectional area of orifice 211 at the opposite surface facing towards the print media; this enhances the straightforwardness of ink drops emitted through orifices 211.

Although the printing mechanism of an ink-jet printer disclosed in the present invention has some features that are similar to features found in conventional ink-jet printers, the following description relates to only the ink-jet printer head of the present invention. In order to form characters or other images upon a predetermined area of a print medium, a head driver should apply a voltage, as an electrical signal, to the corresponding individual electrode 206 through the respective electrical connector 212, and, simultaneously, apply a voltage of the opposite polarity to nozzle plate 210, the common electrode. A direct current voltage with the range of approximately 0V~100V is applied across the respective electrodes 206 and 210, an electrical current of between approximately 0A~5A flows across individual electrodes 206 and common electrode 210. The electricity flows through the conductive ink which exhibits a resistivity between individual electrodes 206 and common electrode 210.

The ink, containing sodium chloride (e.g., NaCl), has an electrical conductivity, and emits heat due to the internal flow of the electrical current against the resistivity of the ink. This electric energy is converted into heat energy according to Joule's law, as P equals $I^2 \cdot R$, (where P represents power; I represents current; and R represents resistance). That is, referring now to FIG. 10A, a difference in the current density is created in the direction represented by the lines of current flow 230 toward nozzle plate 210 from individual electrodes 206. The ink emits heat in ink chambers 209 due to its internal current and resistivity according to the difference in the current density. As the density of current 230 is increased a first bubble 232 is formed. When bubbles are first produced in ink chambers 209 around the middle of the individual and common electrodes, as shown in FIG. 10B, the current density flows around the first bubble 232 formed in the ink, and does not pass through the bubble.

As the current density 230 is increased around bubble the current becomes greater. Heat is generated by the increase of power so that ink bubbles 234 are consecutively produced around the first bubble 232. In other words, once the first ink bubble is produced, as the current density is increased around the first bubble, bubbles are produced successively, and some big bubbles are formed by connection and transformation (i.e., by merger) of these bubbles, thereby increasing the steam pressure. There is a consecutive generation of bubbles within selected ink chambers 209 by the corresponding application of electric energy to the electrodes for a predetermined period of time, which causes production of high steam pressure and change in the volume of the bubbles. The ink contained in the ink chambers 209 is forced out through orifices 211 of nozzle plate 210. The ink pushed out of orifices 211 is in the shape of small drops in the nozzle formed by nozzle plate 210, and if the electric energy, applied to first electrode 206, is cut off, the formation of bubbles in ink chambers 209 stops. At the same time, those ink drops at the nozzle that are about to be sprayed are separated from each other due to the internal voltage drop, and are then jetted out onto a print medium. The ink held in the ink container (not separately illustrated) refills the ink chambers through the ink via 37 and ink chamber barriers 208. Characters are formed on the print media by successively repeating the ink spray and ink refill, with the application of the electrical signals across the nozzle plate and the individual electrodes corresponding to the details of the images to be printed upon the print media.

According to the principles of the present invention, the nozzle plate is used as a common electrode, and the individual electrodes are formed on the substrate, thus creating the ink drops to be sprayed onto a print media under the force of steam pressure created by the current density between the common and individual electrodes. Since the present invention uses the heat generated by the product of the ink's internal current and the resistivity of the ink, and the current flow created due to the difference of the current density made by applying the voltage with different polarity across the common and individual electrodes, there is no need to form protective layers during the manufacture of the print head.

In the conventional art, because the ink bubbles are produced and burst right on the outer surface of each of the resistor and heating portions, the outer surfaces may be damaged by a shock wave created by the generation or breaking of the ink bubbles, thus reducing the operational lifetime of the head. Embodiments constructed according to the principles of the present invention however, do not have such a disadvantage. Besides, heads constructed according to these principles have a simple internal structure, which lowers the production costs. The nozzle plate, serving as a common electrode, controls the size of each of ink drops only, and may be formed as a very thin plate, thus reducing the time it takes to manufacture the nozzle plate as well as the overall production cost. In addition, since each of the orifices has a sectional area formed at the surface facing toward the print media that is smaller than the sectional area of the orifice formed at the surface facing toward the ink chambers, the steam pressure is maintained at a predetermined magnitude, thereby enhancing the straightforwardness and the directivity of travel by the ink drops emitted.

It will be apparent to those skilled in the art that various modifications and variations can be made in the ink-jet printer head and ink spraying method for an ink-jet printer of the present invention without departing from the spirit or scope of the invention. Thus, it is intended that the present invention cover the modifications and variations of this invention provided they come within the scope of the appended claims and their equivalents.

What is claimed is:

1. An ink jet printer head, comprising:

a substrate;

an oxidized layer formed on said substrate;

a plurality of individual electrodes each formed as a discrete layer on top of said oxidized layer, each of said electrodes having a middle region exposed to an electrically conductive ink, and side regions;

a plurality of electrical insulation layers covering said side regions;

a nozzle plate serving as a common electrode, said nozzle plate spaced-apart and electrically insulated from said plurality of individual electrodes and perforated by a plurality of orifices through which ink particles may be sprayed onto print media;

a plurality of ink chamber barriers interposed between said electrical insulation layers and said nozzle plate to form a plurality of distinct ink chambers, said ink chamber barriers and electrical insulation layers electrically isolating said plurality of individual electrodes from said nozzle plate;

said ink chambers being bounded by said ink chamber barriers and said electrical insulation layers, each ink chamber temporarily storing a separate quantity of the ink, and accommodating a formation of bubbles of the ink generated by a difference of density in electric current between the plurality of individual electrodes and said nozzle plate;

said electrical insulation layers preventing current leakage to said plurality of individual electrodes through ink not contained in said ink chambers; and a plurality of electrical connectors connecting said nozzle plate to said plurality of individual electrodes to furnish electric energy to selected ones of said plurality of individual electrodes and said nozzle plate to print an image upon media exposed to the ink selectively projected through said plurality of orifices.

2. An ink-jet print head according to claim 1, wherein the ink has a predetermined resistivity value.

3. An ink-jet printer head according to claim 2, wherein the ink contains sodium chloride for electrical conductivity.

4. An ink-jet printer head according to claim 1, wherein the individual electrodes and nozzle plate are each formed of an alloy of nickel and platinum for preventing erosion by the conductive ink.

5. An ink-jet printer head according to claim 1, further comprising a source of direct current connected to the electrical connectors for forming the ink bubbles by the ink's internal heat caused by an internal flow of the electrical current against a resistivity of the ink, said bubbles forming in said ink chamber only and not on a surface of said nozzle plate.

6. An ink-jet printer head according to claim 5, said source of direct current being for applying voltage to the individual electrodes and nozzle plate in the range of 0 V to 100 V.

7. An ink-jet printer head according to claim 5, said source of direct current being for applying current to the individual electrodes and nozzle plate in the range of between approximately 0 Amperes to 5 Amperes.

8. An ink-jet printer head according to claim 1, wherein the ink chamber barriers are bonded to the nozzle plate by a glue.

9. An ink-jet printer head according to claim 1, wherein the ink chamber barriers are sealed to the nozzle plate by thermal welding.

10. An ink spraying method for an ink-jet printer, comprising the steps of:

forming a plurality of individual electrically isolated electrodes and a nozzle plate serving as a common electrode and perforated by a plurality of discrete spaced-apart orifices, said plurality of individual electrodes and said nozzle plate being vertically spaced apart and electrically isolated from each other;

using barriers and insulation layers as border walls defining discrete ink chambers corresponding to different ones of said orifices to increase a force of ink flowing between said nozzle plate and said plurality of individual electrodes, said nozzle plate and said plurality of individual electrodes being separated by said barriers and said insulation layers; and producing ink bubbles by the use of a heat energy generated by a conductive ink's internal current and resistivity so that said ink bubbles are jetted through an orifice of said nozzle plate by applying signals characterized by differences in voltage across said nozzle plate and selected ones of said plurality of individual electrodes to print images represented by said signals upon a media.

11. An ink spraying method for an ink-jet printer according to claim 10, wherein once a first ink bubble is generated, successively producing other bubbles as a current density is increased around said first bubble, said bubbles containing hot air that mixes with said ink and increases a steam pressure of said ink.

12. An ink-jet printer head, comprising:

a silicon substrate;

a silicon dioxide layer formed on said silicon substrate;

an electrode layer formed on said silicon dioxide layer, said electrode layer defining a floor of an ink chamber for containing an electrically conductive ink;

an electrical insulating layer formed on a portion of said electrode, said electrical insulating layer defining a lower portion of walls of the ink chamber, said electrical insulating layer for preventing current leakage from said electrode to other electrodes on the silicon substrate;

an ink chamber barrier layer formed on said electrical insulating layer, said ink chamber barrier layer defining the upper portion of the wall of the ink chamber;

an electrically conducting nozzle plate serving as a common electrode formed on the ink chamber barrier layer, said nozzle plate spanning a region over the ink chamber and said nozzle plate having an orifice which has a larger cross-sectional area at the surface of the nozzle plate facing inward toward the ink chamber than on the surface of the nozzle plate opposite the ink chamber, wherein an electric current flows between said nozzle plate and said electrode layer and forms a bubble due to the heat generated in the conductive ink by the electric current.

13. The ink-jet printer head of claim 12, further comprising:

a second electrode formed on said silicon substrate, for defining the floor of a second ink chamber;

said electrical insulating layer further defining a lower portion of the walls of the second ink chamber;

said ink chamber barrier layer further defining an upper portion of the walls of the second ink chamber; and said nozzle plate spanning the region over the second ink chamber and having a second orifice over the second ink chamber.

14. The ink-jet printer head of claim 12, further comprising:

said electrode and said nozzle plate each being formed of an alloy of nickel and platinum.

15. The ink-jet printer head of claim 12, further comprising:

said orifice having walls which are linear in a cross-section perpendicular to the surface of the nozzle plate.

16. The ink-jet printer head of claim 12, further comprising:

said orifice having walls which are curved convex toward the interior of the orifice in a cross-section perpendicular to the surface of the nozzle plate.

17. A method of spraying ink, comprising the steps of providing a conductive ink in an ink chamber comprising:

a silicon substrate;

a silicon dioxide layer formed on said silicon substrate;

an electrode formed on said silicon dioxide layer, said electrode layer defining a floor of the ink chamber;

an electrical insulating layer formed on a portion of said electrode, said electrical insulating layer defining a lower portion of walls of the ink chamber, said electrical insulating layer for preventing current leakage from said electrode to other electrodes on the silicon substrate;

an ink chamber barrier layer formed on said electrical insulating layer, said ink chamber barrier layer defining the upper portion of the walls of the ink chamber;

an electrically conducting nozzle plate serving as a common electrode formed on the ink chamber barrier layer, said nozzle plate spanning a region over the ink chamber, and said nozzle plate having an orifice which has a larger cross-sectional area at the surface of the nozzle plate facing inward toward the ink chamber than on the surface opposite the ink chamber;

applying a direct current voltage between the nozzle plate and the electrode to pass current through the ink, heat the ink due to the ink's internal current and resistivity and thereby cause the ink to bubble; and then stopping the application of the direct current voltage.

18. The method of claim 17, said step of applying a direct current voltage comprising applying a current in the range of approximately 0 to 100 V.

19. The method of claim 17, said step of applying a direct current voltage comprising causing a current of in the range of approximately 0 to 5 A to flow between the nozzle plate and the electrode.

* * * * *